United States Patent [19]

Arceneaux

[11] 4,176,723

[45] Dec. 4, 1979

[54] DIAMOND DRILL BIT

[75] Inventor: Leonce Arceneaux, Spring, Tex.

[73] Assignee: DTL, Incorporated, Spring, Tex.

[21] Appl. No.: 850,471

[22] Filed: Nov. 11, 1977

[51] Int. Cl.[2] ..... E21B 9/36

[52] U.S. Cl. ..... 175/329

[58] Field of Search ..... 175/329, 340, 398; 76/108 R, 108 A

[56] References Cited

U.S. PATENT DOCUMENTS

| | | | |
|---|---|---|---|
| 2,838,284 | 6/1958 | Austin | 175/329 |
| 3,135,341 | 6/1964 | Ritter | 175/329 |
| 3,175,629 | 3/1965 | Rowley | 175/329 |
| 3,318,400 | 5/1967 | Hildebrandt | 175/329 |
| 3,709,308 | 1/1973 | Rowley | 175/329 |
| 3,823,789 | 7/1974 | Garner | 175/340 |
| 3,825,083 | 7/1974 | Flarity et al. | 175/329 |

FOREIGN PATENT DOCUMENTS

| | | | |
|---|---|---|---|
| 237701 | 2/1969 | U.S.S.R. | 175/329 |

*Primary Examiner*—William Pate, III

*Attorney, Agent, or Firm*—James L. Jackson

[57] ABSTRACT

A diamond drill bit construction for drilling bores in earth formations and the like, according to the present invention, comprises a drill body that is adapted for connection thereof with a drill stem and defines internal fluid passage means through which drilling fluid flows during drilling operations. A plurality of spaced stabilizer pads are formed on the drill body defining a portion of the external surface area thereof and defining a plurality of fluid courses between adjacent stabilizer pads with the fluid courses being in communication with the fluid passage means of the drill body. A plurality of diamonds are supported by the drill body and are arranged on each of the bearing pads such that a portion of each of the diamonds is positioned at the trailing edge of a respective one of the fluid courses and such that the cutting depth of each of the diamonds is controlled by the bearing pads. The diamonds are arranged in single rows on the bearing pads with the bearing pads and rows of diamonds extending to the apex center of the bit. Fluid jets may be located suitably about the drilling face of the bit or the flow of fluid may be otherwise controlled by the configuration of the face of the bit so as to provide optimum flow of drilling fluid at the immediate vicinity of the apex.

17 Claims, 10 Drawing Figures

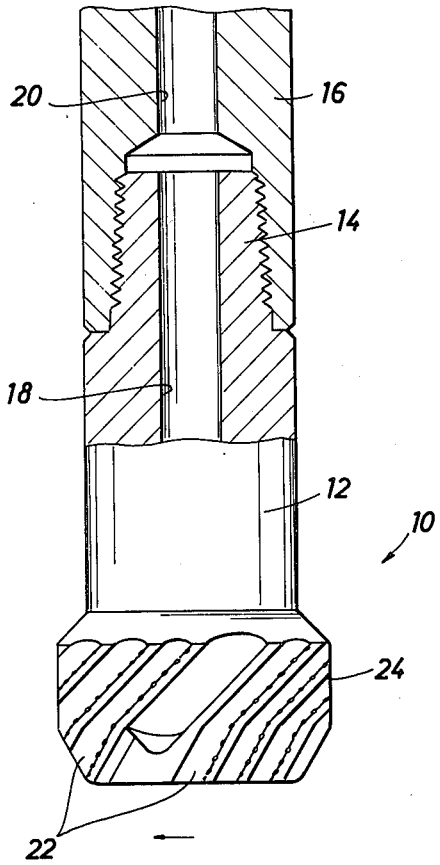
FIG.1
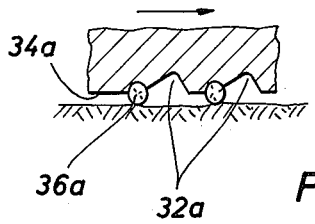
FIG.4
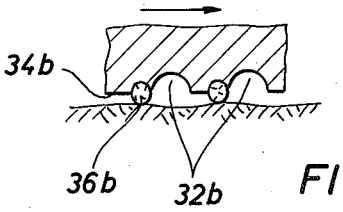
FIG.5
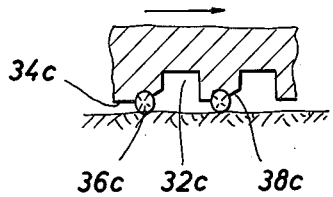
FIG.6
FIG. 2
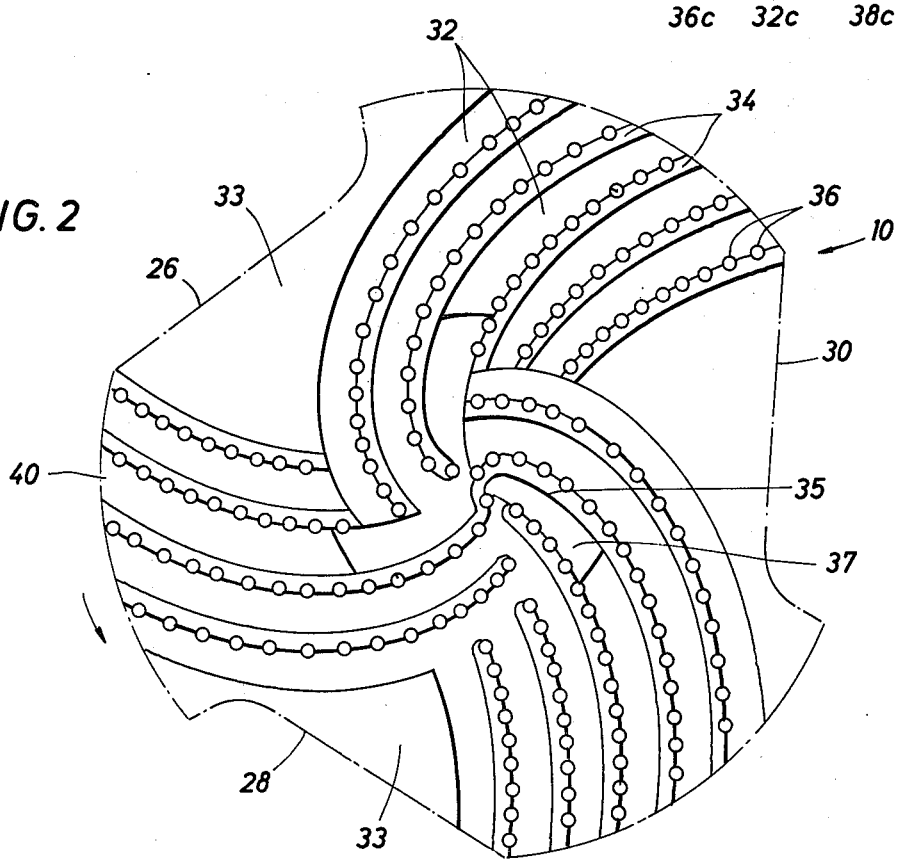

DIAMOND DRILL BIT

FIELD OF THE INVENTION

This invention relates generally to apparatus for drilling bores in earth formations and the like and more specifically relates to diamond drill bits for drilling bores in hard earth formations and other hand materials. Even more specifically, the present invention relates to a diamond drill bit construction wherein each of the diamonds is positioned at the leading edge of an associated bearing pad and at the trailing edge of a waterway such that formation particulate cut away be each of the diamonds is directed immediately into the associated waterway for immediate transportation away from the diamonds so that efficient cutting operation is promoted and drill vibration or chattering is reduced.

BACKGROUND OF THE INVENTION

In drilling and boring holes in earth formations, especially those formations that are of relatively hard nature, it is typical for rotary diamond bits to be employed. Diamond bits are rotated in the presence of a circulating drilling fluid medium that serves to achieve cooling of the bit during its cutting operation and to remove drill cuttings from the cutting face and sides of the bit as drilling operations progress. In most diamond bits, the diamonds project from the bit matrix or body in which they are embedded with projection being such that the diamonds contact the formation in such manner as to provide a clearance between the matrix and the surface of the formation. The lands defined by the matrix generally define fluid courses that radiate outwardly from one or more apertures through which drilling fluid medium is ejected through the bit structure into the well bore. Cooling of the bit and particulate removal occur as the drilling fluid medium flows across the land at high velocity in the space between the matrix and the formation. Penetration of the bit into the formation is generally controlled by the mechanical pressure that is applied to the bit as drilling operations continue. Of course, the formations vary considerably and therefore penetration of the diamonds into the formation tends to vary considerably. As is expected, variation in the penetration of the diamonds results in substantial change in the effective size of the clearance between the matrix and the formation and consequently causes the cooling ability of the fluid supply system to be varied.

At times drill cuttings will become trapped between the bit and the formation and the bit, thus developing extremely high compression loads on the bit which can result in excessive wear. Also, quick and repetitive accumulation and release of drill cuttings from beneath the bit can cause chattering and vibration that is also detrimental to the life of the bit.

A major problem with diamond bits concerns the degree of diamond wear that occurs during drilling operations. Because the diamonds are much harder than the formation materials that are drilled, what is typically taken as "wear" generally concerns the amount diamond fracturing that occurs as diamond drill bits are used. Where several diamonds are positioned in the matrix such that drilling fluid transports particulate from a leading diamond to a trailing diamond in some cases the particulate becomes wedged between the trailing diamonds and the formation. Suddenly, the trailing diamond is subjected to a tremendous compression load due to the wedging action and this load causes the diamond to fracture. After each of the diamonds of a bit structure have become fractured, the diamonds are considered to have become worn to the point that its cutting ability is not proper. It is deemed that extended cutting life of diamond drill bits will be materially enhanced if the drill cuttings are not allowed to engage trailing diamonds and develop shearing loads. It is also considered that excessive fracturing of diamonds will not occur if the particulate material is immediately projected into the waterways and transported away from the cutting side.

Another problem associated with diamond drilling bits concerns the inability of the penetration rate of the bit to be precisely controlled as drilling operations continue. As mentioned above, penetration of the diamonds into the formation is generally determined by the hardness of the formation and the amount of mechanical force applied to the drill bit as it is rotated relative to the formation. It is considered desirable to limit the amount of penetration that can occur and to insure that each of the diamonds on the cutting face of the bit penetrate into the formation a predetermined amount and maintain such predetermined penetration at all times. Drill bits tend to chatter and vibrate against the formation because penetration of the diamonds cannot be precisely controlled. This chattering and vibration is extremely detrimental to the service life of diamond drill bits.

A further problem concerns the typical inability of diamond drill bits to accomplish efficient drilling near the center of the contact area between the face of the bit and the formation. The outer portions of diamond bits typically drill more rapidly than the inner or apex portions primarily because of inefficient cleaning capacity of the flowing drilling fluid and the multiple stone center without clearance for cutting. The fluid supply and control arrangement afforded by most diamond drill bits causes fluid flow to be rather sluggish at the central portion of such bits, causing transportability of the drill cuttings to be rather poor. The cuttings interfere with the cutting action of the innermost diamonds and cause increased wear and slow drilling at the apex center. This causes the bit to hang on its center and vibrate or chatter in the hole.

As mentioned above, it is desirable that drill cuttings be removed from the cutting face of the bit as soon as possible after separation from the formation. It is desirable to insure high velocity flow of the drilling fluid medium through the fluid courses in order that the drilling cuttings loosened by the diamonds are efficiently transported from the drilling site. It is desirable to provide drill bit apparatus that is designed to utilize the rotary speed of the drill bit to materially enhance the cleaning capacity of the flowing drilling fluid-medium.

THE PRIOR ART

Single rows of cube diamonds have been arranged on the cutting face of a diamond drill bit as taught by U.S. Pat. No. 2,709,308 which shows the diamonds arranged in generally radial rows and with the leading or cutting faces of the diamonds also arranged generally radially to enhance cutting of certain formations such as relatively soft or evaporite formations. The central portion of this bit structure will not cut as rapidly as the outer portions thereof because the fluid will flow more slowly at the central portion than at the outer portion. The multistones without relief in the center further compound this inefficient cutting medium. Curved or spiral waterways and lands is shown by U.S. Pat. Nos. 2,838,284, 3,095,935 and 3,181,632. In each case, these patents depict drill bit construction wherein a plurality of diamonds are positioned on each of the lands and therefore drilling fluid must traverse the lands in order to provide appropriate cooling and particulate removal.

With the foregoing in mind, it is an important feature of the present invention to provide a diamond drill bit construction that effectively retards chatter and vibration as drilling operations occur.

It is also an important feature of the present invention to provide a novel diamond bit construction wherein the diamonds are so oriented relative to the bit structure and the waterways that any tendency of the diamond to fracture during drilling operations is effectively retarded.

Among the several objects and features of the present invention is noted the contemplation of a novel diamond drill bit construction wherein penetration of the diamond into the formation is precisely controlled and maximum cutting ability is achieved even during changes of the formation.

Another feature of the present invention concerns the provision of a novel diamond bit construction with the leading edge of each of the diamonds exposed to the trailing edge of an associate fluid course through which drilling fluid flows, thereby promoting rapid and efficient removal of drill cuttings at both the inner apex and outer portions of the cutting face immediately upon separation thereof from the formation.

It is another feature of the present invention to provide a novel diamond bit construction wherein cuttings separated from the formation are caused to move freely into the fluid stream of the flowing drilling fluid without interfering with other diamonds and without wedging between the bit and the formation.

Another feature of the present invention involves the provision of a novel diamond drill bit construction having fluid courses that spiral outwardly across the face of the bit and promotes added cleaning forces of the drilling fluid medium for efficient transportation of drill cuttings from the cutting face of the bit.

It is another feature of the present invention to provide a novel diamond drill bit construction employing stabilizer pads to promote smooth and straight drilling of the formation.

A further feature of the present invention concerns the provision of a novel diamond drill bit construction that is efficient in use and low in cost.

Other and further objects and advantages and features of the present invention will become apparent to one skilled in the art upon consideration thereof. The form of the invention which will now be described in detail illustrates the general principles of the invention but it is to be understood that this detailed description is not to be taken as limiting the scope of the present invention.

SUMMARY OF THE INVENTION

A preferred embodiment of the present invention comprises a diamond drill bit construction for drilling bores in earth formations such as in the drilling of wells, boring operations for mining and the like. The drill bit construction includes a drill bit body having connection means formed thereon for connection with a drill stem. The drill body is formed to define internal fluid passages through which drilling fluid flows during drilling operations. A plurality of spaced therefor pads are formed on the drill body and define a portion of the external surface area of the drill bit construction. The bearing pads also define a plurality of fluid courses between adjacent bearing pads with the fluid courses being in communication with the fluid passage means of the bit construction. To provide for cutting of the formation, a plurality of diamonds are supported by the drill body and are arranged in single rows on the bearing pads with a portion of each of the diamonds being positioned at the trailing edge of a respective one of the fluid courses. The stabilizer pads and fluid courses are defined of spiral configuration with the fluid courses being in communication with side fluid courses for transporting the drilling fluid medium past the side surfaces of the drill bit where the fluid medium then may flow through the drill bore away from the drilling site.

The diamonds retained in the matrix of the drill body project beyond the surface of the bearing pads by a predetermined amount. During drilling operations, the bearing pad surfaces are in engagement with the formation and the diamonds project into the formation by a predetermined amount that is desirable for optimum cutting of the formation. The smooth sections defined by the stabilizer pads of the drill bit construction will regulate the penetration per revolution to prevent excessive penetration even when changing formation is encountered. The bearing pads and stabilizer pads will maintain efficient contact with the formation and prevent chattering or vibration that is well known to be detrimental to the effective service life of the diamond of a drill bit.

The diamonds of the drill bit construction are set in spiral rows along the stabilizer pads with the leading edge of each of the diamonds exposed to the slanted trailing edge of a fluid course. This allows cuttings to move freely into the fluid stream without interfering with other diamonds and without allowing the cuttings to become wedged between the diamonds and the formation. By providing a path of least resistance for the drill cuttings to enter the flowing stream of drilling fluid medium, the cuttings become immediately entrained to the drilling fluid and are transported away from the cutting face of the bit immediately upon separation from the formation.

Each of the diamonds projects slightly into one of the fluid courses and is embedded to a predetermined depth within the formation during each revolution. Loosened formation material is pushed ahead of each of the diamonds into the fluid courses and is immediately transported away so that there is no possibility of particulate interference with the cutting action of the diamonds. Because the diamonds are embedded to the full cutting depth within the formation, it is highly unlikely that loosened formation material will wedge between the diamonds and formation and thereby develop a shearing or fracturing force on the diamonds.

The fluid courses on the cutting face of the drilling bit are oriented at approximately 30° in respect to any radial passing through the center line of the bit and are of curved configuration. As the bit rotates, centrifugal force imparted to the flowing drilling fluid medium enhances the flow and assists mechanically in the cooling and cleaning effect of the fluid. The bearing pad and stabilizer pads continuously engage the formation during drilling operations and thereby prevent the development of chattering or vibration that might otherwise cause excessive wear of the diamonds and thereby assists in maintaining a straight bore during drilling operation.

The fluid supply system for accomplishing cooling of the bit and removal of drill cuttings is designed to accomplish efficient flow of the drilling fluid at the apex or central portion of the drilling face of the bit. This is accomplished by designing the fluid supply openings of the bit and the fluid courses such that back pressure exists immediately as the drilling fluid exits the bit opening or openings. This will insure that efficient flow of drilling fluid occurs at all portions of the fluid courses, especially those portions at the central or apex portions of the bit. This can be accomplished by providing a restriction or restrictions at the bit openings to insure that the total cross-sectional area of the bit openings does not exceed the total cross sectional area of the fluid courses.

A plurality of jet inserts may be connected to the drill body with the combined cross-sectional area of the jets being designed not to exceed the cross-sectional area of the fluid courses. Each of the jets may be formed to define internal partially conical surfaces with the smaller opening thereof defining the opening through which drilling fluid exits the bit and flows into the fluid courses.

BRIEF DESCRIPTION OF THE DRAWINGS

So that the manner in which the above recited features, advantages and objects of the present invention as well as others, which will become apparent are attained and can be understood in detail, more particular description of the invention briefly summarized above may be had by reference to the embodiments thereof which are illustrated in the appended drawings, which drawings form a part of this specification.

It is to be noted, however, that the appended drawings illustrate only representative embodiments and are not to be considered as limiting the scope of the invention, for the invention may admit to other equally effective embodiments.

IN THE DRAWINGS

FIG. 1 is an elevational view of diamond drill bit constructed in accordance with the present invention.

FIG. 2 is a bottom view of the diamond drill bit of FIG. 1 illustrating orientation of the diamonds, stabilizer pads and fluid courses of the bit structure.

Figure 3:
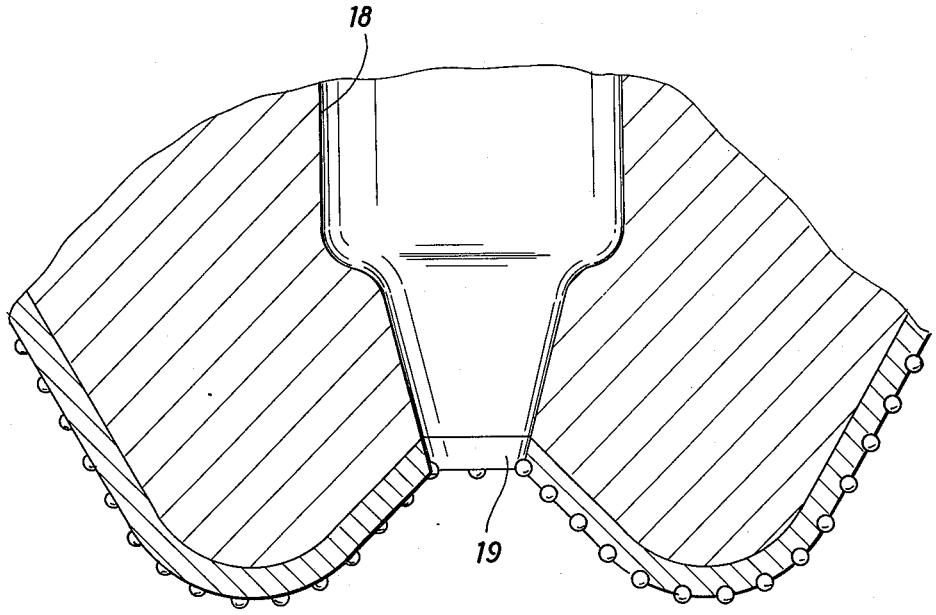

FIG. 3 is a fragmentary sectional view of the drill bit structure of FIGS. 1 and 2, illustrating the restricted fluid passage of the bit structure.

FIG. 4 is a fragmentary sectional view of the diamond bit structure of FIGS. 1 and 2 and illustrating the configuration of the stabilizer pads and fluid courses and further illustrating positioning of the diamonds relative to the fluid courses and bearing pads.

FIG. 5 is a fragmentary sectional view of a diamond drill bit construction representing a modified embodiment of the present invention and showing the particular design of the bearing pads and fluid courses as well as positioning of the diamonds relative thereto.

FIG. 6 is a fragmentary sectional view representing a further modified embodiment of the present invention and showing the structure of the bit that defines the bearing pads and fluid courses, and further showing the relationship of the diamond to the bearing pads and fluid courses.

Figure 7:
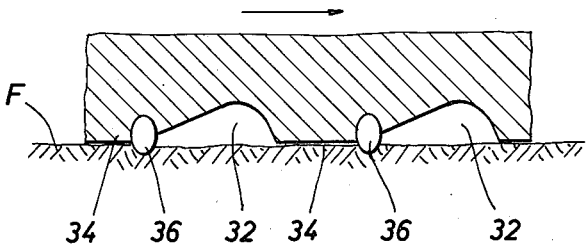

FIG. 7 is an operational view in fragmentary section illustrating positioning of the diamonds and the matrix of the bit forming the bearing pads during operations with the diamond drill bit of the present invention.

Figure 8:
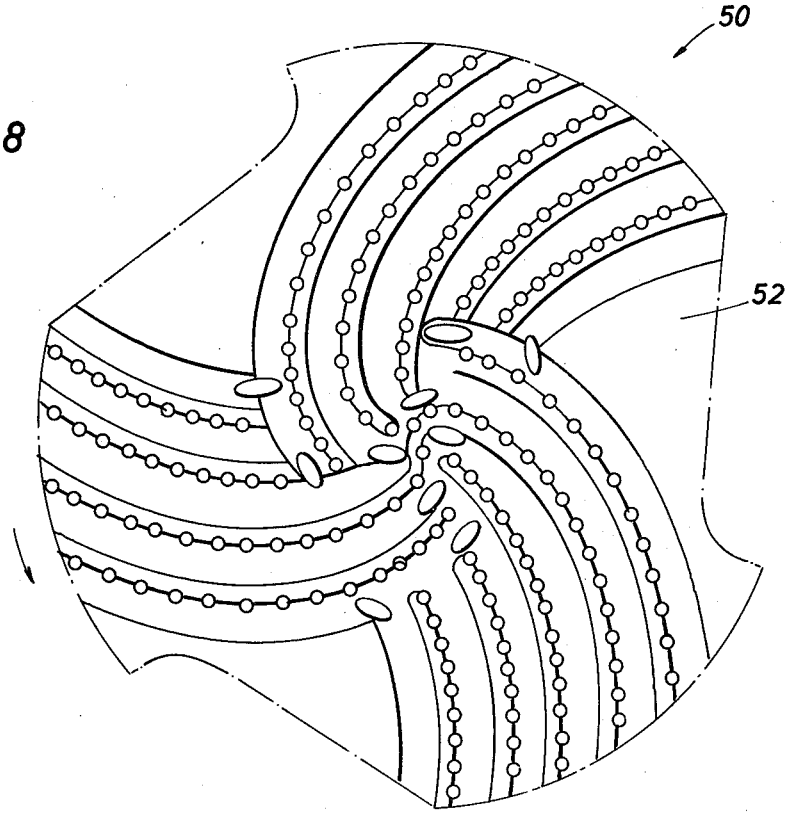

FIG. 8 is a bottom view of a diamond drill bit constructed in accordance with the present invention and reflecting an alternative embodiment of the invention.

Figure 9:
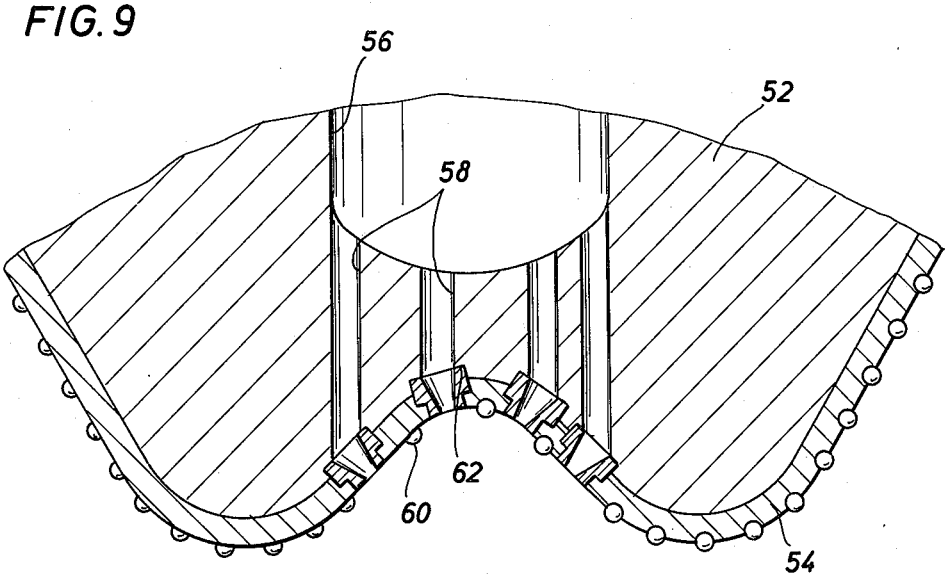

FIG. 9 is a fragmentary sectional view of the diamond drill bit of FIG. 8, illustrating a plurality of jet inserts being positioned to receive fluid from a plurality of fluid passages connected to a central fluid supply passage.

Figure 10:
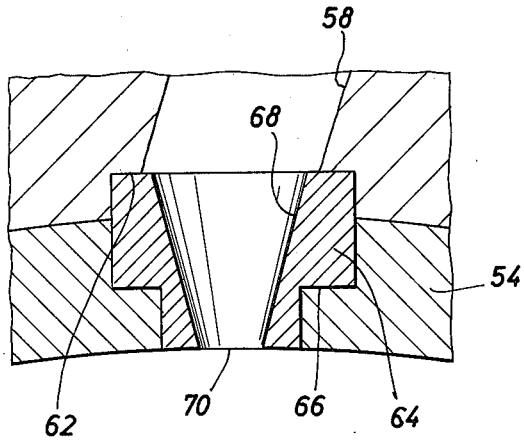

FIG. 10 is an enlarged fragmentary sectional view of the diamond drill bit structure of FIG. 9, illustrating one of the jet inserts in detail and showing the relationship of the insert to the drill body and matrix.

With reference now to the drawings and first to FIG. 1, there is shown a diamond drill bit structure generally at 10 defined by a body portion 12 having a threaded upper extremity 14 that adapts the bit structure for threaded connection to a drill stem such as shown at 16. Within the body portion 12 of the bit may be defined a fluid passage 18 that communicates with a drilling fluid passage 20 formed in the drill stem 16 and terminates at a face portion 22 of the drill. During drilling operations, drilling fluid will be forced under pressure through the passages of the drill stem and drill and will serve as a coolant and cutting removal medium in the area of engagement between the drilling face 22 and the formation being drilled.

The drill body 12 is generally formed of steel such as a forging or casting and the crown or lower portion of the drill defines side surfaces 24 as well as the face portion 22 of the drill. The matrix material is formed exterially to define junk slots and fluid courses and serves to support the diamond cutting elements in the manner described in detail hereinbelow. It is desirable that the matrix material have a high degree of errosion resistance and have considerable strength to provide adequate support for the diamond cutting elements. A typical matrix material may be composed of a copper-nickel alloy containing powdered tungsten carbide in quantities sufficient to confer the required strength and errosion resistance. Other matrix compositions such as are well known in the art may also be effectively employed within the spirit and scope of the present invention.

It is desirable to provide a diamond drill bit construction wherein optimum cooling effect and removal of drill cuttings is efficiently accomplished during drilling operations. A drill bit having the capability for effective cooling and efficient removal of drill cuttings may conveniently take the form illustrated particularly in FIG. 2 which is a bottom view showing the face portion of the drill bit construction illustrated in FIG. 1. As illustrated, the drill bit construction 10 is formed to define junk slots 26, 28 and 30 that extend upwardly along the side portion of the drill bit. The matrix at the face portion of the bit is formed to define a plurality of fluid courses such as at 32, stabilizer pads as shown at 33 and bearing pads such as hown at 34. The fluid courses and bearing pads are of curved configuration, with any portion of curvature deviating approximately 30° from a radial extending through the center line of the bit. By curving the fluid courses and bearing pads in a helical manner as shown causes the loose particle removability of the flowing fluid medium to be enhanced mechanically by the centrifugal force developed during rotation of the bit structure. The cleaning ability of the flowing fluid medium, being greater than if radial fluid forces were utilized, causes cooling and removal of drill cuttings to be more efficiently accomplished as compared to typical bit constructions.

On each of the bearing pads is located a single row of diamond cutting elements such as shown at 36. Each of the diamond cutting elements is supported by the matrix and is positioned such that the leading portion thereof is positioned at the trailing portion of one of the fluid courses 32. Placement of the diamond cutting elements with the leading portions thereof in communication with the trailing portion of adjacent fluid courses allows the formation particulate loosened by the diamond cutting elements to be forced directly into the flowing fluid medium in the fluid courses. The fluid medium is therefore effectively transported away from the immediate cutting portion of each of the diamonds and therefore is not likely to interfere with the cutting ability of any of the other diamonds of the bit construction. As indicated above, in many other diamond bit constructions sand and other particulate material cut away from the formation by one of the diamond cutting elements can wedge between a trailing diamond element and the formation being drilled. When this occurs, tremendous forces are developed that tend to shear and fracture the diamond elements. In this manner, the diamond elements are said to become "worn" and the bit construction then must be replaced or repaired. In the case of the present invention, the diamond cutting elements are in single rows on each of the bearing pads and therefore formation particulate loosened during drilling operations will not have any tendency to become wedged between the diamonds and the formation. With regard to FIG. 2, it is evident that rotation of the drill bit in the direction of the rotation arrow will cause any particulate material that is not forced into a preceeding fluid course to be traversed by a succeeding fluid course, thereby insuring that virtually all of the particulate material will be displaced into a high velocity fluid course during drilling operations and will not tend to interfere with the cutting action of succeeding diamond cutting elements.

Referring now to FIG. 3, which illustrates the lower portion of the bit structure of FIGS. 1 and 2 in fragmentary sectional view, it will be apparent that the internal fluid passage 18 is restricted at the outer portion thereof so as to define a restricted orifice 19. The restricted orifice 19 will be of equal or smaller cross-sectional dimension than the cross-sectional dimension of the fluid courses of the bit structure. This feature insures that no back pressure is created outwardly of the apex or central portion of the bit face and thus insures optimum flow of the drilling fluid medium within those portions of the fluid courses that are located within the central apex portion. This optimum flow of the drilling fluid medium enhances the cleaning capability as well as cooling capability within the apex portion without in any way adversely affecting flow at the outer portions of the fluid courses. Thus, more efficient cutting ability occurs within the apex portion than is typical and bit life is also materially enhanced.

It is evident that the fluid courses of the present invention may take a number of different forms within the spirit and scope hereof. With reference to FIG. 4, fluid courses such as shown at 32 A may be of generally V-shaped configuration with the diamond cutting elements 36A positioned on the bearing pads 34A in such manner that the leading portion of each of the diamond cutting elements is positioned at the trailing edge of an associated fluid course. As shown, the particulate material loosened from the formation by the diamonds 36A is forced directly into the associated fluid course for immediate transportation away from the formation being drilled. It should also be borne in mind that the high velocity fluid medium, because it will be in immediate and continuous contact with the cutting portion of each of the diamond elements at all times, will provide optimum cooling ability and thereby will reduce diamond wear.

With reference to FIG. 5, the fluid courses 32B will have a generally semi-circular cross sectional configuration and the diamond cutting elements 36B will be placed in the matrix material defining the bearing pads 34B in such manner that the leading edges of the diamond cutting elements are exposed to the trailing portions of the respective fluid courses.

As shown in FIG. 6, the fluid courses 32C may be of generally rectangular cross-sectional configuration and the diamond cutting elements 36C may be supported by the matrix material defining the bearing pads 34C such that a leading portion of each cutting elements 36C is exposed to the trailing portion of respective ones of the fluid courses. In this connection, the matrix material defining the fluid courses may be tapered as shown at 38C thereby causing the matrix to adequately support the diamond cutting elements and yet expose a cutting portion thereof to the trailing portions of trailing fluid courses.

In connection with FIGS. 4, 5 and 6, directional arrows indicate the direction of movement of the bit structure relative to the formation.

As explained above, it is typical for the penetration of diamond cutting elements of conventional diamond bits to penetrate into the formation to a depth somewhat less than the exposed depth of the diamonds. Penetration into the formation is typically controlled by the degree of mechanical pressure that is applied to the drill stem during drilling operations and the softness or hardness characteristics of the formation being drilled. It is desirable to provide formation cutting ability at a desired optimum cutting depth, regardless of the mechanical pressure applied and the consistency of the formation to thereby achieve optimum cutting ability of the diamonds. It is also desirable to reduce or substantially eliminate vibration or chattering that typically occurs as diamond drill bits are rotated relative to the formation. Such vibration or chattering causes the drill bit to shift laterally during rotation and therefore may cause the bore that is being drilled to deviate from the intended drilling course. Chattering or vibration of the drill bit can be caused by granular formation material that becomes wedged between the diamonds and the formation, which may develop an upward temporary force on the drill bit and drill stem.

With reference now to FIG. 7, which is a fragmentary sectional view of the drill bit structure illustrated in FIGS. 1 and 2, the formation being drilled is shown at F and the direction of bit rotation is illustrated by the directional arrow located at the upper portion of FIG. 7. When drilling operations are conducted the bearing pads 34 are each in initimate engagement with the formation and each of the diamond cutting elements 36 are embedded in the formation to a maximum extent that is determined by the height of the diamond cutting elements relative to the bearing pads. Regardless of the amount of mechanical pressure that is applied to the drill bit through the drill stem, the diamond cutting elements 36 will not vary the penetration thereof. Because they are continually embedded to a full cutting depth thereof into the formation at all times during drilling operations, wedging action of particulate material between the diamonds and the formation will not occur. Each of the diamond cutting elements will be cutting the formation at all times during rotation of the drill bit and no forces will be developed that will tend to shear or fracture the diamond elements as drilling operations continue. Moreover, because the bearing pads 34 are continually in engagement with the formation, rotation of the drill bit will be smooth and free of vibration and chattering. The bore drilled by the drill bit will not tend to deviate or wander during drilling operations as a result of the smooth vibration free operation and it will be less likely that bore correction activities will be necessary in most drilling operations.

By embedding the diamond cutting elements to a maximum efficient cutting depth within the formation during drilling operations, the drilling of medium and hard formations will be faster, coupled with longer bit life. Through employment of the drilling bit of the present invention the cost per foot of drilling operations will be substantially reduced as compared with conventional drilling bits and therefore will materially enhance the commercial feasibility of drilling operations.

It is desirable to keep the formation area being drilled free of any accumulation of drill cuttings. It is appropriate therefore to insure that the formation being drilled is flushed as quickly and as efficiently as possible in order that the drilling cuttings will not tend to interfere with the cutting ability of the diamond cutting elements. In accordance with the present invention, and as shown in FIG. 1, the junk slots 26, 28 and 30 of the drill bit are also disposed in spiral relations, being angulated in the order of 45° with respect to the vertical. In addition, side fluid courses are formed by the matrix material such as shown at 40 and these fluid courses are also of spiral configuration, being angulated in the order of 45° with respect to the vertical. The upward spiral flow of drilling fluid medium that is induced as the drilling bit rotates materially enhances the mechanical ability of the flowing fluid medium which results in efficient cleaning and cooling. The high velocity fluid medium effectively transports drilling cuttings upwardly from the fluid courses 32 into the bore that has been drilled and as such promotes faster drilling operations and longer service life of drill bits as compared with conventional drill bit structures. The higher efficiency fluid that is developed by the spiral fluid courses side slots will assist in preventing clogging of the fluid courses that might otherwise result in overheating and excessive diamond wear. Any loose cuttings or any other debris that may find its way into the lower pressure junk slots 26, 28 and 30 will be mechanically moved away from the bit face and up into the well bore by the 45° trailing edge of the junk slot.

In the case of the drill bit structure illustrated in FIG. 2, it should be noted that one of the bearing pads extends entirely across the apex center of the drilling face of the bit and the restricted opening 37 also extends near the apex center of the bit. This insures that the diamond elements located immediately near the apex center of the bit structure will be adequately cleaned and cooled by the flowing drilling fluid medium. The restricted opening 37 must be equal to or less than the fluid courses 32.

With reference now to FIG. 8, which illustrates a bottom view of a diamond bit construction formed in accordance with the present invention and reflecting a modified embodiment of the invention the diamond bit construction may take a similar general form as illustrated in FIG. 2 with the exception of the fluid supply orifices. As shown in FIG. 8, the bit structure illustrated generally at 50 may include a body portion 52 having matrix material 54 connected thereto. The body portion 52 may also be formed to define a central fluid supply passage 56 from which may extend a plurality of smaller fluid supply passage 58 that terminate at the drilling face portion 60 of the bit structure.

The matrix material 54 is structured to define a plurality of bearing pads, stabilizer pads and fluid courses that are of potentially identical construction as compared to the structure illustrated in FIG. 2. The diamonds of the bit structure are oriented in curvilinear rows with the forward portion of each of the diamonds extending into the trailing portion of adjacent fluid courses in the manner also discussed in connection with FIG. 2. The stabilize pads, being the same height as the bearing pads, and also being in continuous engagement with the formation, serve to limit the penetration depth of the diamonds to the full cutting extent thereof.

As shown in FIG. 9, the body portion 52 of the bit structure may be formed to define a plurality of insert recesses 62 within which may be located orifice insert element 64. The orifice insert elements may also be formed to define shoulder portions 66 that cooperate with the matrix material 54 to retain the inserts in connection with the bit structure. Each of the inserts, as shown in FIG. 10, is formed with a tapering internal wall structure as shown at 68 and defines a restricted opening 70 through which drilling fluid flows from the fluid supply passages and exits at the drilling face of the bit. The restricted apertures 70 may be of any suitable configuration for insuring adequate flow of fluid in the area of the drilling face of the bit, such as the oval configuration illustrated in FIG. 8. It should also be noted that the several restricted orifices are located in the vicinity of the apex or central portion of the bit structure thereby providing optimum flow and efficient cleaning characteristics at the central portion of the bit. The total area of the restricted apertures 70 is equal or less than the area of the fluid courses. This feature promotes adequate and efficient removal of drill cuttings during cutting operations and also insures optimum cooling of the diamonds. By providing optimum cooling and efficient removal of cuttings in the apex portion of the bit, the cutting action of the diamonds located in the apex portion will be materially enhanced and the service life of the bit will be enhanced accordingly. It should be noted that several of the restricted orifices are located very near the apex center of the bit structure in order that the diamonds located immediately at the apex will be efficiently cooled and cleaned and will therefore not tend to become excessively worn during drilling operations.

It is therefore apparent that the present invention is one well adapted to attain all of the objects and advantages hereinabove set forth, together with other advantages which will become obvious and inherent from a description of the drill bit structure according to the teachings of the present invention. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in a limiting sense.

Having thus fully described my invention in detail, I claim:

1. A diamond drill bit construction for drilling bores in earth formations and the like, said drill bit construction comprising:

a drill body having connection means formed thereon for connection with a drill stem, said drill body being formed to define internal fluid passage means through which drilling fluid flows during drilling operations;

a plurality of spaced bearing pads being formed on said drill body defining a portion of the external surface area and defining a plurality of fluid courses between adjacent bearing pads, said fluid courses being in communication with said fluid passage means said bearing pads engage said formation and limit penetration of said diamonds into said formation; and a plurality of diamonds being supported by said drill body and being arranged on each of said bearing pads, the leading portion of each of said diamonds being positioned at the trailing edge of a respective one of said fluid courses said diamonds extending substantially to the center of the bit.

2. A diamond drill bit construction as recited in claim 1, wherein:

said diamonds are arranged in single rows on said bearing pads and at least one of said rows traversing the apex center of the bit.

3. A diamond drill bit construction as recited in claim 1, wherein:

each of said bearing pads and fluid courses are of generally spiral configuration.

4. A diamond drill bit construction as recited in claim 1, wherein:

a plurality of stabilizer pads are formed on the drill body, said stabilizer pads being of the same height as said bearing pads and cooperating with said bearing pads to control the depth of penetration of said diamonds into said earth formation and limiting wear of said stabilizer pads.

5. A diamond drill bit construction as recited in claim 1, wherein:

said body construction is formed to define side fluid courses, said side fluid courses being continuations of said plurality of fluid courses.

6. A diamond drill bit construction as recited in claim 5, wherein:

each of said bearing pads and fluid courses is of spiral configuration; and said body construction is formed to define a plurality of side fluid courses, said side fluid courses being continuations of said plurality of fluid courses and being of generally spiral configuration of substantially 45° from the vertical.

7. A diamond drill bit construction as recited in claim 1, wherein:

said diamonds project beyond said bearing pads sufficiently to define a predetermined cutting depth, said bearing pads engaging said formation during drilling operations and limiting penetration of said diamonds into said formation to said predetermined cutting depth.

8. A diamond drill bit construction as recited in claim 7, wherein:

a plurality of stabilizer pads are defined by said body construction, said stabilizer pads engage said formation to limit penetration of said diamonds into said formation and to limit wear of said stabilizer pads by said formation.

9. A diamond drill bit construction as recited in claim 2, wherein:

said diamonds are oriented in single rows along the leading edges of each of said bearing pads.

10. A diamond drill bit construction as recited in claim 9, wherein:

said diamonds project beyond said bearing pads sufficiently to define a predetermined cutting depth, said bearing pads engaging said formation during drilling operations and limiting penetration of said diamonds into said formation to said predetermined cutting depth.

11. A diamond drill bit construction as recited in claim 10, wherein:

each of said bearing pads and fluid courses is of generally spiral configuration; and said body construction is formed to define a plurality of side fluid courses, said side fluid courses being continuations of said fluid courses and being of generally spiral configuration.

12. A diamond drill bit construction as recited in claim 11, wherein:

said fluid courses are oriented substantially 30° in respect to a radial; and said side fluid courses are oriented substantially 45° from the vertical.

13. A diamond drill bit construction as recited in claim 1, wherein:

said internal fluid passage means define at least one restricted outlet opening means communicating directly with said fluid courses, the cross-sectional dimension of said restricted outlet opening means being less than the accumulated cross-sectional dimension of said fluid courses.

14. A diamond drill bit construction as recited in claim 13, wherein:

a plurality of jet inserts are retained by said drill body, said restricted outlet opening means is defined by the accumulated cross-sectional dimension of said jet inserts.

15. A diamond drill bit construction as recited in claim 14, wherein:

said jet inserts define retainer shoulder means; and matrix material, defining a portion of said drill body, engages said retainer shoulder means to retain said jet inserts in assembly with said drill body.

16. A diamond drill bit construction as recited in claim 14 wherein:

tapered passage means is defined within each of said jet inserts and defines a restricted outlet opening.

17. A diamond drill bit as recited in claim 13, wherein:

said restricted outlet opening means is of oval configuration.

* * * * *